United States Patent [19]

Kawaguchi

[11] 4,173,118

[45] Nov. 6, 1979

[54] FUEL COMBUSTION APPARATUS EMPLOYING STAGED COMBUSTION

[75] Inventor: Katsuyuki Kawaguchi, Nagasaki, Japan

[73] Assignee: Mitsubishi Jukogyo Kabushiki Kaisha, Tokyo, Japan

[21] Appl. No.: 829,240

[22] Filed: Aug. 31, 1977

Related U.S. Application Data

[63] Continuation of Ser. No. 606,794, Aug. 22, 1975, abandoned.

[30] Foreign Application Priority Data

| | | | |
|---|---|---|---|
| Aug. 27, 1974 | [JP] | Japan | 49-97517 |
| Aug. 27, 1974 | [JP] | Japan | 49-97518 |
| Dec. 3, 1974 | [JP] | Japan | 49-137709 |

[51] Int. Cl.[2] ..... F02C 7/22

[52] U.S. Cl. ..... 60/39.65; 431/352

[58] Field of Search ..... 60/39.65, 39.74 R, DIG. 11; 431/351-353, 4

[56] References Cited

U.S. PATENT DOCUMENTS

| | | | |
|---|---|---|---|
| 2,638,745 | 5/1953 | Nathan | 60/39.65 |
| 2,676,460 | 4/1954 | Brown | 60/39.65 |
| 2,951,339 | 9/1960 | Benson | 60/39.65 |
| 3,608,309 | 9/1971 | Hill et al. | 60/39.65 |
| 3,643,430 | 2/1972 | Emory et al. | 60/39.65 |
| 3,747,336 | 7/1973 | Dibelius et al. | 60/39.55 |
| 3,793,828 | 2/1974 | Chesters | 60/39.74 R |
| 3,851,465 | 12/1974 | Verdouw | 60/39.65 |
| 3,851,466 | 2/1974 | Verdouw | 60/39.65 |
| 3,907,488 | 9/1975 | Takahashi et al. | 431/2 |
| 3,937,008 | 2/1976 | Markowski et al. | 60/39.65 |

*Primary Examiner*—Robert E. Garrett

[57] ABSTRACT

A fuel combustion apparatus comprising a double concentric combustion cylinder having an outer cylinder and an inner cylinder concentric with, and shorter than, the outer one, said inner cylinder being located in the upstream portion of the space and extending axially to form an annular space between itself and the outer cylinder, a plurality of fuel injection valves installed in a circular arrangement at the head of the annular space, combustion air swirlers mounted around the fuel injection valves, one for each, with the same angle of swirl in a given direction, another combustion air swirler installed at the inner end of the inner cylinder and having an angle of swirl in the direction reverse to that of the said swirlers, and a plurality of air holes formed confinedly in the wall portion of the outer cylinder surrounding the inner end of the inner cylinder and also in the wall portion of the outer cylinder at a distance of not less than the diameter of the outer cylinder downstream from the said first air holes.

7 Claims, 11 Drawing Figures

FUEL COMBUSTION APPARATUS EMPLOYING STAGED COMBUSTION

This is a Continuation Application of Ser. No. 606,794 filed Aug. 22, 1975, now abandoned.

This invention relates to improvements in the fuel combustion apparatus.

Conventional combustion apparatus are as typically represented in FIGS. 1 and 2. In those Figures the combustor is shown as comprising an inner cylinder 02 in the center of the apparatus and an outer cylinder 01 coaxial with the inner one. On the upstream end of the combustor are mounted a plurality of fuel injection valves 04, each of which being surrounded by an air swirler 05.

Both inner and outer cylinders are formed with a multiplicity of combustion air holes 013. Air for combustion is introduced into the combustion space through the swirlers 05, a center swirler 06 at the downstream end of the inner cylinder 02, and the air holes 013 of the inner and outer cylinders 02, 01, and the resulting air streams flow in the directions indicated by arrows in FIG. 1.

Drops of liquid fuel from the fuel injection valves 04 mix with the air supplied through the swirlers 05, 06 and air holes 013, thus forming a continuous combustion zone 014.

The ordinary combustor of the double-cylinder construction described above has the following disadvantages:

(1) Since a plurality of fuel injection valves 04 are disposed between the two concentric cylinders, each pair of adjacent valves provides an interference with the swirling stream and thereby reduces the swirl effect. As represented by curves A and B in FIG. 3, it is noted that, with the double-cylinder combustor, the combustion efficiency is higher when the angle of swirl $\theta$ by the swirlers is 45° than when it is 35°. For this reason swirlers with the swirl angle of 45° have in many cases been preferred. As FIG. 4 shows, the smoke characteristic is the most desirable when the swirl angle ranges between 30° and 35°. Nevertheless, in the majority of cases, the swirlers with the swirl angle of 45° that achieve good combustion efficiency have to be employed at the sacrifice of the smoke characteristic.

(2) The large number of air holes 013, successively disposed over a long distance on the downstream side of the gas inlets, provide a correspondingly elongated combustion zone. Moreover, the penetration of air jets is limited and the air fuel mixing progresses unsatisfactorily, with consequent increases in the smoke and NOx contents of the exhaust. (Refer to FIG. 5)

(3) In an attempt to control the smoke and NOx emissions, it has been proposed to supply a large volume of air around the fuel injection valves 04 to increase the air fuel ratio. However, the proposed method is of little practical importance because of poor ignitability and instability of combustion.

The object of the present invention is to eliminate the disadvantages of the existing equipment and to provide a fuel combustion apparatus capable of reducing both smoke and NOx emissions.

Features of the invention are as follows:

(1) A plurality of fuel injection valves are installed at the head of an annular space formed between inner and outer cylinders, and air swirlers adapted to revolve in the same direction are disposed around the valves, one for each.

(2) An air swirler adapted to revolve in the reverse direction is mounted at the inner end of the inner cylinder.

(3) A plurality of air holes, each of which is provided with a scoop, are formed in the wall portion of the outer cylinder surrounding the inner end portion of the inner cylinder.

(4) Dilution air holes, each of which is provided with a scoop, are formed in the wall portion of the outer cylinder, at a distance of not less than the diameter of the cylinder downstream from the air holes mentioned in (3) above.

(5) Water feeding means is provided for the combustion of heavy grades of fuel oil.

According to the present invention, the following are accomplished:

(A) The primary combustion zone is limited within the annular space. Rich mixture combustion is carried out by supplying air at an air ratio (i.e., the ratio of the amount of supplied air to the theoretical amount of air) of not more than 40% only through the swirlers mentioned in (1) above.

(B) Air is admitted to the downstream combustion space through the swirlers of (2) and through the air holes of (3), both of which are provided at the points where the combustion flames under the rich mixture conditions terminate, so that the addition to the air at the air ratio of not more than 0.4 will increase the overall air ratio of 1.05–1.30. With the excess air the gas having a large unburned content is burned again under lean mixture conditions. Where more air is used, a third zone for rapid cooling (or a dilution zone) is provided so that the gas is diluted to control the NOx formation.

(C) A reducing atmosphere may be provided in the lean mixture combustion zone by the addition of moisture. In this way the gasification efficiency is increased and the NOx and smoke emissions are both reduced.

The present invention is expected to find wide applications, such as in boilers and gas turbines. For use with boilers operating at low percentages of excess air, the apparatus of the invention may either close its dilution zone holes or dispense with the zone itself. Conversely if the percentage of excess air is high, as in a gas turbine, the gas in the apparatus of the invention may be cooled to a desired temperature in the dilution zone.

The invention has additional features and advantages as follows:

(1) An even number of fuel injection valves are installed, in a circular arrangement, at the head of an annular space, combustion air swirlers are provided around the valves, one for each, and the individual fuel injection valve-air swirler systems (hereinafter called "burners") are disposed in such a manner that the swirler of each system or burner revolves with an angle of swirl reverse to those of the adjacent burners, thereby precluding any interference of its air swirl with the neighboring ones.

(2) The even number of burners vary in the capacity of the fuel injection valves or of the air swirlers or in the both. In other words, the burners that operate with a high or low ratio of supplied air to the theoretical air, or with rich or lean mixture, are alternately arranged. This improves the ignitability and combustion stability.

Further advantages of the invention include the following:

(1) In order to avoid the interference by the adjacent air swirlers, each fuel injection valve surrounded by an air swirler is provided with a separator of a conical, cylindrical, or coni-cylindrical shape in the combustion zone in the vicinity of the particular valve.

(2) A swirl angle of swirlers ($\theta=30°-35°$) that provides the most desirable smoke characteristic is combined with the feature mentioned in (1) above to increase the combustion efficiency and improve the smoke and NOx characteristics.

(3) In the independent combustion zones formed by the separators and the adjacent fuel injection systems, the combustion conditions of rich and lean air fuel mixtures are alternately given in a cyclic arrangement. As a whole an air fuel ratio with a high combustion efficiency (which usually increases the NOx emission) is used and yet the process of combustion in accordance with the invention produces less NOx.

(4) The cyclic combination of rich and lean mixtures assures good ignitability and combustion stability, and also stable operation.

The above and other objects, advantages, and features of the invention will become more apparent from the following description taken in conjunction with the accompanying drawings showing embodiments thereof. In the drawings.

Figure 6:
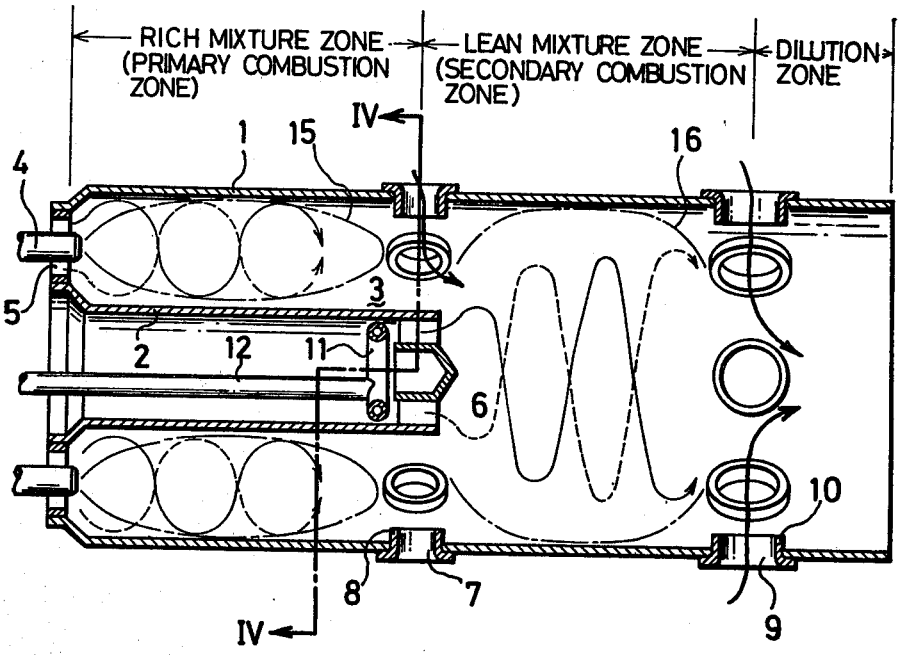
FIG. 6 is a longitudinal sectional view of a combustion apparatus embodying the invention, taken on the line III—III of FIG. 7.
Figure 7:
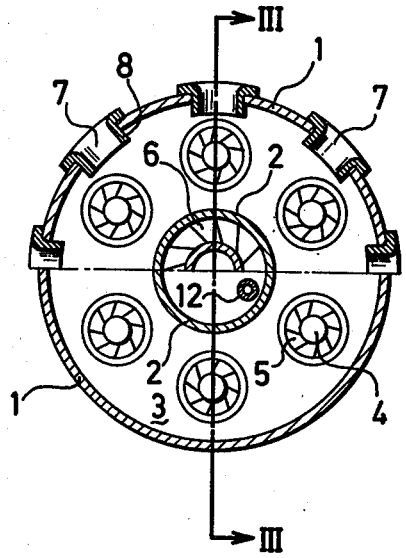
FIG. 7 is a cross sectional view taken on the line IV—IV of FIG. 6.

Referring now to FIGS. 6 and 7, there are shown an outer cylinder 1 and an inner cylinder 2 located coaxially in the upstream space of the outer cylinder 1, the two cylinders defining an annular space 3 therebetween. A plurality of fuel injection valves 4 are installed, in an equi-spaced circular arrangement, on the upstream end of the annular space 3. The same number of swirlers 5 for primary combustion air are disposed, each around one of the valves, with their blades revolvable in the same direction. At the downstream end of the inner cylinder 2 is mounted a swirler 6 for secondary combustion air whose blades are revolvable in the reverse direction. A plurality of holes 7 for secondary combustion air are formed through the wall portion of the outer cylinder 1 surrounding the downstream end of the inner cylinder 2, each said hole being provided with a scoop 8. Similar holes 9 for dilution air are formed in the outer cylinder 1 at points of a distance not less than the diameter of the outer cylinder downstream from the secondary combustion air holes 7. Each of the holes 9 is provided with a scoop 10. In the vicinity of the secondary combustion air swirler there is mounted a water of steam injector 11. A water or steam supply pipe 12 is communicated at one end with the water or steam injector 11 and at the other end with the delivery outlet of a pump not shown.

On the walls of the outer cylinder 1 and the inner cylinder 2 there are no perforations with the exception of the secondary combustion air holes 7 and dilution air holes 9 at the specified points and also of air hole loopers (not shown) for cooling the walls.

Simultaneously with the introduction of liquid fuel from the fuel injection valves 4, the primary combustion air swirlers 5 surrounding the individual valves supply air for combustion in a combined amount of not less than 40% of the amount of air theoretically required for the combustion.

On the other hand, the secondary combustion air swirler 6 and secondary combustion air holes 7 supply air which when combined with the air from the primary combustion air swirlers will amount to from 1.05 to 1.30 times as much as the theoretical air. Where the total air ratio exceeds 1.30, the rest of air is supplied by the dilution air holes 9. When a heavy grade of oil or the like is used as fuel, water or steam is issued from the injector 11.

The operation of the apparatus constructed as above will now be explained.

In the annular space 3, which is merely supplied with not more than 40% of the theoretical amount of air by means of the primary combustion air swirlers 5, there is formed a zone 15 where the gaseous mixture with a high fuel concentration is incompletely burned. In this zone the unburned portion of liquid fuel is gasified with heat.

Around the inner end of the inner cylinder 2, a large amount of fresh air is supplied from the secondary combustion air swirler 6 and secondary combustion air holes 7 to the incompletely burned gas. As a result, a zone 16 where a gaseous mixture with a low fuel concentration is to be completely burned is formed in the space downstream from the inner end of the inner cylinder 2 (on the right side as viewed in FIG. 6).

Since the direction in which the blades of the secondary combustion air swirler 6 revolve is reverse to that of the blades of the primary combustion air swirlers 5, the fuel gas in swirling streams produced in the primary combustion zone 15 mixes well with the freshly supplied air.

Also, because the secondary combustion air holes 7 are concentrically directed toward the inner end portion of the inner cylinder 2 with the aid of the scoops 8, the momentum of air penetration toward the central axis is large enough to provide more thorough mixing of air and fuel.

Water or steam issued by the injector 11 is carried by the streams of combustion air to form a reducing atmosphere.

From the dilution air holes 9 air is supplied, with its penetration increased by the scoops 10. It mixes with the combustion gas from the secondary combustion zone and rapidly cools the gas.

With the operation described, the apparatus of the invention offers the following advantages:

(1) Since a plurality of fuel injection valves 4 are provided for an annular space 3 and each said valve is equipped with a swirler to effect combustion under conditions of rich mixtures, (a) ignitability and combustion stability are improved, (b) combustion temperature is low and NOx production decreases (See FIG. 5), and (c) air and fuel mix well, and the rich mixture flame can be limited within this zone.

Figure 5:
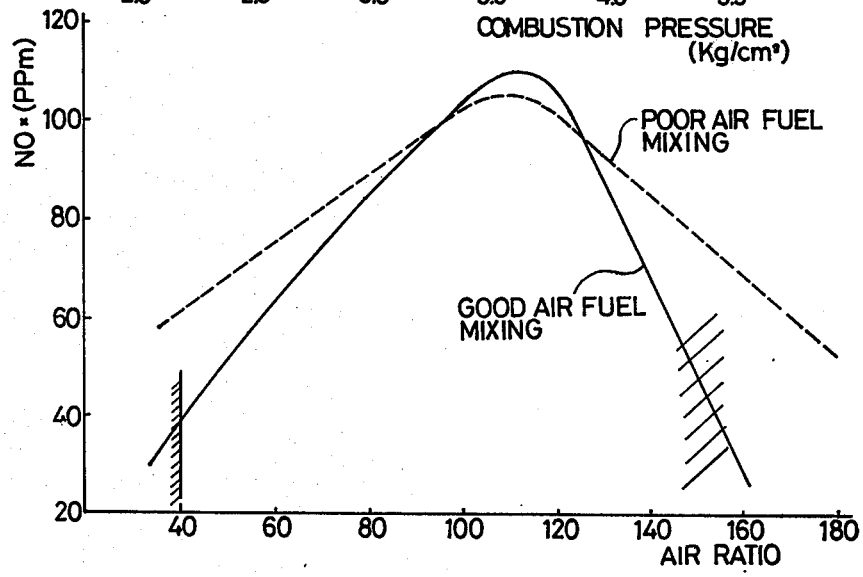
FIG. 5 is a graph showing the relationship between the NOx concentration and air ratio.

(2) The fuel gas mixes thoroughly with the air from the swirler 6 at the inner end of the inner cylinder 2 and from the air holes 7 of the outer cylinder 1, and the resulting mixture burns under lean mixture conditions. This permits the carbon and unburned fuel from the primary combustion zone to burn under the lean mixture conditions. Consequently, the smoke is reduced and the NOx emission is kept at a low level (FIG. 5)

(3) Because $H_2O$ is supplied together with the swirling air streams, the water droplets are blown out into the outer region of the combustion space, and the combustion gas, air, and water are mixed well. In this manner the hydrocarbon fuel is decomposed by $H_2O$ to give birth to CO or $CO_2$ and $H_2$, thus accomplishing gasification of the fuel. The reaction being endothermic, it is usually necessary to supply air and burn again the unburned portion and carbon from the primary combustion zone so that resulting heat is utilized. With the apparatus of the invention, this heat of reaction is used in gasification and, therefore, reduction of both smoke and NOx emissions is realized simultaneously with an improvement in fuel quality.

(4) In the case of combustion with much excess air, a dilution zone is added to the rear end of the secondary combustion zone, and all the remainder of air is supplied for rapid cooling. This shortens the retention time of hot gas and decreases the NOx discharge.

While the injection of water or steam in the embodiment just described is done by a nozzle, the fluid being admitted from a ring pipe to the cylindrical combustion space together with the air from the air holes, it is possible, alternatively, to premix the water or steam into the fuel and allow the fuel injection valves to inject the mixture instead of fuel alone.

Figure 8:
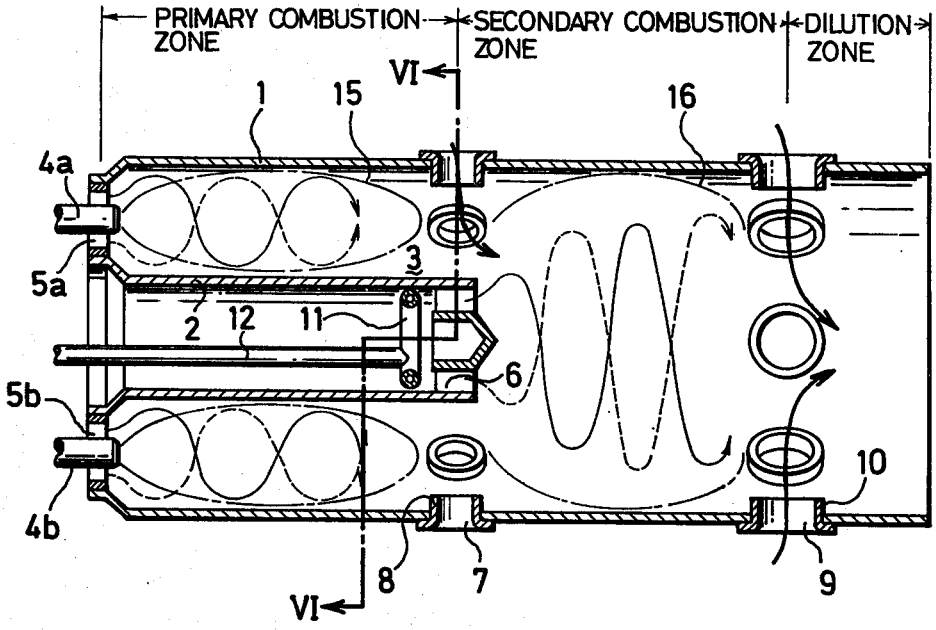
FIG. 8 is a longitudinal sectional view of another form of combustion apparatus according to the invention, taken on the line V—V of FIG. 9.
Figure 9:
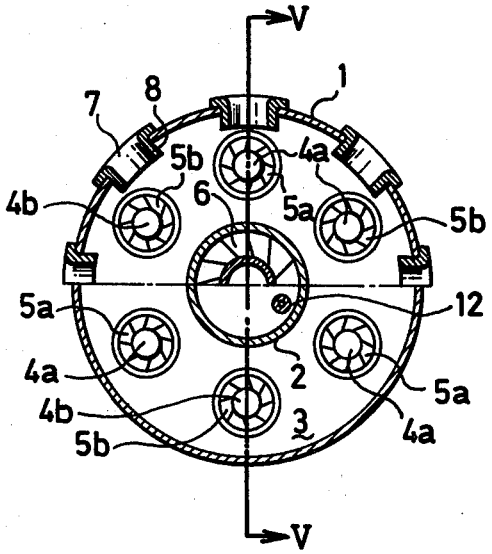
FIG. 9 is a cross sectional view taken on the line VI—VI of FIG. 8.

Referring to FIGS. 8 and 9, an even number of fuel injection valves 4*a*, 4*b* are shown as arranged in a circle on the upstream end of a cylindrical space 3 having an annular cross section. The valves 4*a*, 4*b* are surrounded, respectively, by primary combustion air swirlers 5*a*, 5*b*, which have blades adapted to revolve in opposite directions alternately, i.e., the blades of swirlers 5*a*, 5*b* revolving in opposite directions.

With the exception of the foregoing, the embodiment illustrated in FIGS. 8 and 9 has the same construction as that of the embodiment shown in FIGS. 6 and 7. Throughout these Figures like reference numerals indicate like or corresponding parts.

The fuel injection valves 4*a*, 4*b*, or the primary combustion air swirlers 5*a*, 5*b*, or the both vary in capacity so that each pair of adjacent valves or swirlers have different capacities. In other words, those which handle air at high and low ratio of the amount of supplied air to the theoretical amount of air (air ratio) are alternately arranged. This means that the burner composed of each valve 4*a* and each swirler 5*a* provides an air fuel ratio dissimilar to that by the burner composed of 4*b* and 5*b*.

With the construction described, the second embodiment operates in the following way.

Liquid fuel injected from the fuel injection valves 4*a*, 4*b* is burned with combustion air supplied from the primary combustion air swirlers 5*a*, 5*b* associated with the valves, thus forming a primary combustion zone 15 in the annular space 3. In this case the air ratios are such that a given burner uses an air ratio of not more than 0.4, for example, and the adjacent burners use a ratio of not less than 1.4.

On the other hand, the secondary combustion air swirler 6 and secondary combustion air holes 7 supply a large amount of fresh air and form a secondary combustion zone 16, where the combustion is concluded.

When the overall air ratio is over 2.0, the remaining air is introduced into the combustion space through the dilution air holes 9.

When a heavy grade of fuel oil or the like is used as fuel, either water or steam is issued from the injector 11.

Thus, in the primary combustion zone, combustion flames of lean and rich mixtures wrapped by air-stream cones swirling in the directions opposite to each other are alternately formed in a circular arrangement. With a gradual downstream movement the flames begin to mix together. In the secondary combustion zone, a large swirling air stream supplied by the secondary combustion air swirler 6 at the inner end of the inner cylinder 2 forces the group of small swirling flames to swirl altogether. At the same time, jets of air are introduced through the secondary combustion air holes 7 of the outer cylinder 1. These jets, with their penetration increased by the scoops 8, agitate the group of small swirling flames. In the manner described the small flames are vigorously mixed up within and without. Then, the unburned portion of the rich mixture is burned and the exhaust is used as part of the combustion air. The overall air ratio in the primary and secondary combustion zones may range at most from about 1.5 to about 2.0. When the amount of air is above this range, rapid cooling is done with jets of air supplied through the dilution air holes 9 with as great a momentum of air penetration as feasible.

With the foregoing construction the embodiment just described presents the advantages summarized below:

(1) Since the swirling air streams from the swirlers arranged side by side intensify the individual flame swirls formed as divided (into flames of lean and rich mixtures) in the primary combustion zone, extremely good ignitability and combustion stability are attained and zones of air fuel ratios for low NOx production (the lean and rich mixture zones shown in FIG. 6) can be utilized. First, the fuel from the rich mixture burners is ignited and the resulting flames are used as pilot torches to light up the gaseous mixture from the lean mixture burners, and then the loads on the both are increased. During this, no instability phenomenon such as blowout occurs.

(2) In the secondary combustion zone the group of small siwrling flames in a circular formation from the primary combustion zone are stirred by the internal swirling air stream and by the jets of air penetrating through the flames from the outside. A stream of uniform gaseous mixture is thus obtained and the unburned contents (mainly carbon) of the rich mixture is burned again. In addition, the recycling combustion effect of the exhaust reduces the smoke and NOx emissions, resulting in clean gas production.

Figure 10:
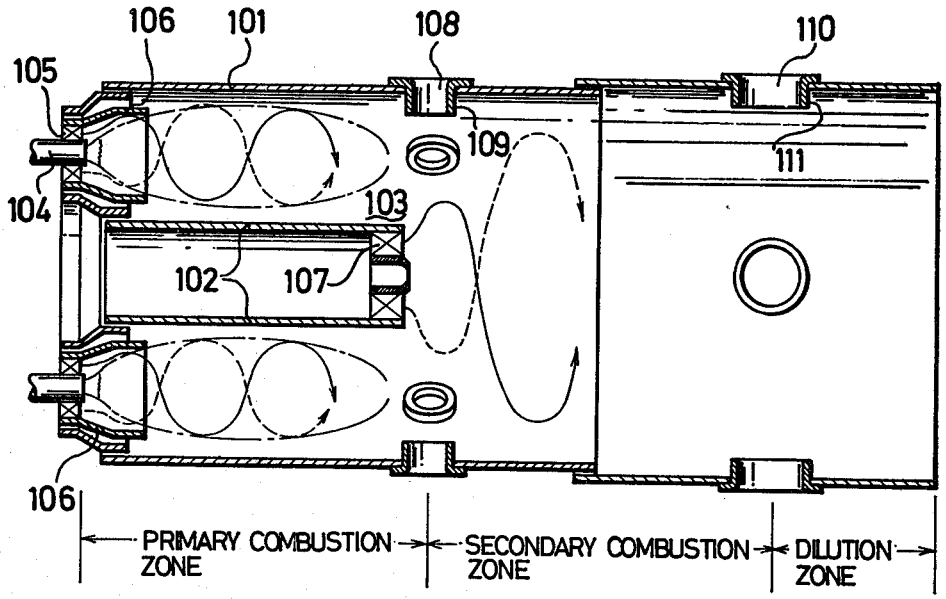
FIG. 10 is a longitudinal sectional view of yet another form of combustion apparatus of the invention.

In FIG. 10 another embodiment of the invention is shown as comprising an outer cylinder 101 and an inner cylinder 102. The inner cylinder is shorter than the outer one and is coaxially accommodated in the upstream space of the outer cylinder, defining an annular space 103 therebetween. A plurality of fuel injection valves 104 are installed in an equi-spaced circular relationship at the upstream end of the annular space 103. Primary combustion air swirlers 105 are mounted around the individual fuel injection valves, one for each. These swirlers have a swirl angle of 30°-35°. Separators 106, in the form of cylinders, cones, or their combinations, are attached around the primary combustion air swirlers 105, one for each, and extend downstream.

Annular air passages are formed on the both outside and inside of each said separator and, if desired, an outer swirler may be mounted in addition to the swirler inside. A secondary combustion air swirler 107 is mounted at the downstream end of the inner cylinder 102. A plurality of secondary combustion air holes 108, each of which is provided with a scoop 109, is formed in the wall portion of the outer cylinder 101 surrounding the downstream end of the inner cylinder 102. A plurality of dilution air holes 111, also provided with scoops 111, are formed through the wall portion of the outer cylinder 101 at points of a distance not less than the diameter of the cylinder downstream from the secondary combustion air holes 108.

The capacity of the fuel injection valves 104 or that of the primary combustion air swirlers 105 or the both vary so that each pair of adjacent valves or swirlers have different capacities. In other words, those which handle air at high and low ratios of the amount of supplied air to the theoretical amount of air (air ratio) are alternately arranged.

The operation of this embodiment will now be described.

Liquid fuel injected from the fuel injection valves 104 is burned with combustion air supplied from the primary combustion air swirlers 105 around the valves, thus forming a primary combustion zone in the annular space 103. In this case the air ratios are such that a given burner uses an air ratio of not more than 0.4, for example, and the adjacent burners use a ratio of not less than 1.4.

Meanwhile, the secondary combustion air swirler 107 and secondary combustion air holes 108 supply a large volume of fresh air and form a secondary combustion zone, where the combustion is concluded.

When the overall air ratio is over 2.0, the remaining air is introduced into the combustion space through the dilution air holes 110.

Figure 1:
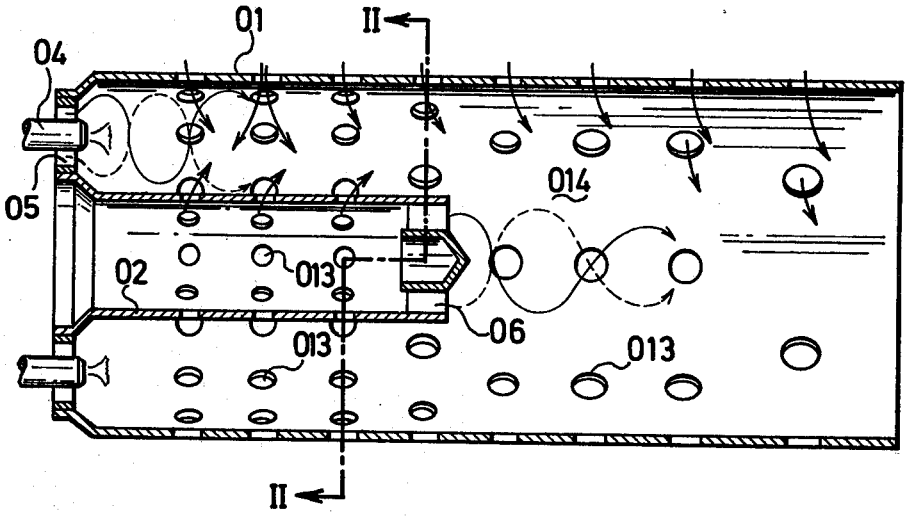
FIG.1 PRIOR ART
FIG. 1 is a longitudinal sectional view of a conventional fuel combustion apparatus, taken on the line I—I of FIG. 2.
Figure 2:
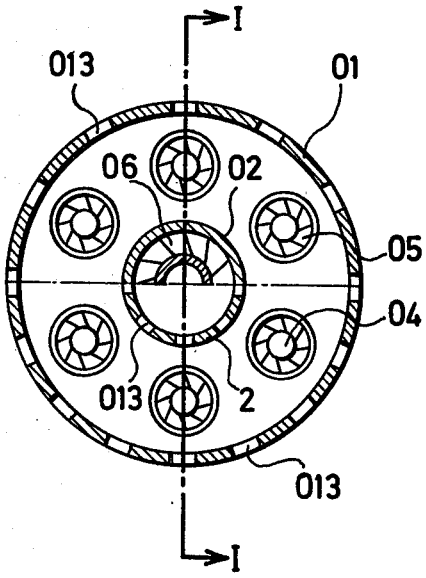
FIG.2 PRIOR ART
FIG. 2 is a cross sectional view taken on the line II—II of FIG. 1.
Figure 3:
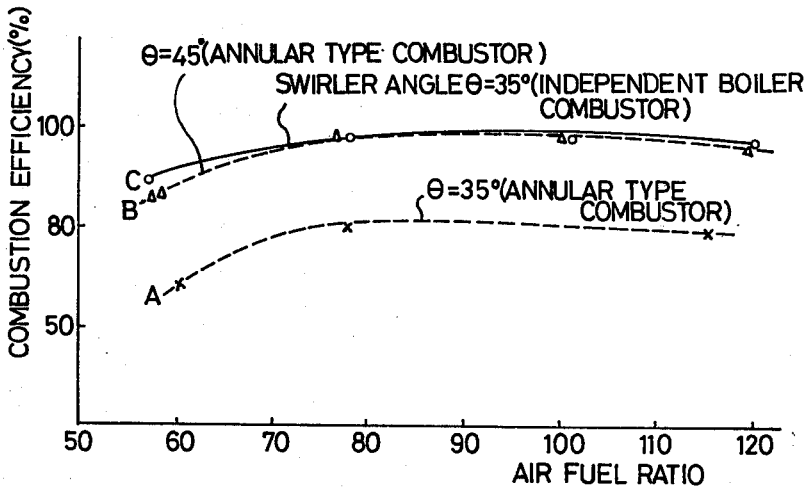
FIG. 3 is a graph indicating the combustion efficiencies of fuel combustion apparatuses relative to the swirl angles of swirlers.
Figure 4:
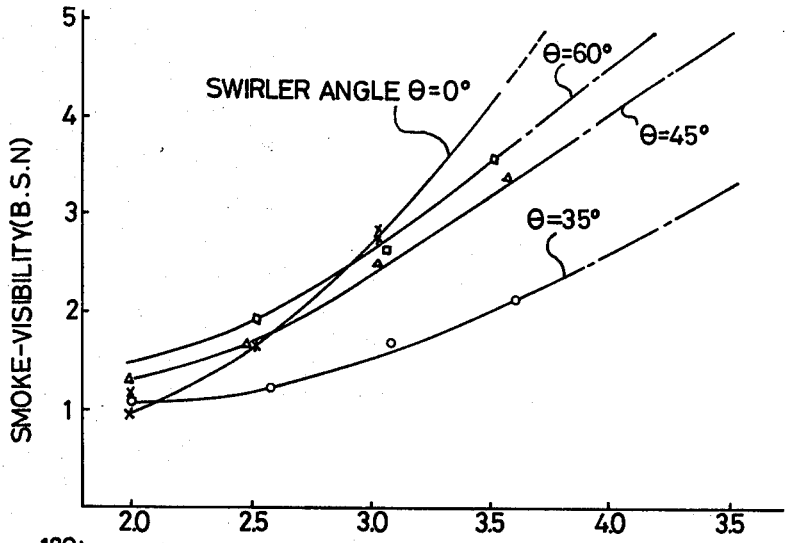
FIG. 4 is a graph indicating the smoke characteristics of fuel combustion apparatuses relative to the swirl angles of swirlers.

This embodiment has the following advantages:

(1) Because the separators 106 provide skirts around the fuel injection valves 104 and their combustion air swirlers 105, each system consisting of each such swirler and each valve causes combustion independently of the other systems in the annular space 103. The combustion near each fuel injection valve that governs the smoke and NOx production is isolated from the rest. In other words, in the proximity of each fuel injection valve, the combustion is carried out independently without interference with the swirling actions of the adjacent swirlers, and in this way divided flames are formed within the primary combustion zone. Thus, a swirl angle for swirlers that gives the best effect upon the combustion efficiency and smoke characteristic can be chosen (for example, $\theta=35°$), as shown in FIGS. 3 and 4. Whereas the combustion efficiency of an annular type combustor designed for a swirler swirl angle of 35° drops substantially, it is possible in accordance with the invention to increase the combustion efficiency while maintaining a satisfactory smoke characteristic as indicated by the curve C in FIG. 3.

(2) In the secondary combustion zone, the group of small swirling flames produced in an annular form in the primary combustion zone is mixed up by the swirling air stream from the inside and penetrating air streams from the outside. The unburned portion (mainly carbon) of the rich mixture thus obtained is burned again while, at the same time, the NOx production is decreased by the exhaust recycling effect.

(3) In the case of combustion with much excess air, all the remaining air is supplied through the dilution zone air holes provided for that occasion so that the combustion gas is rapidly mixed with the air and cooled and the retention time of hot gas is shortened to reduce the NOx emission.

Figure 11:
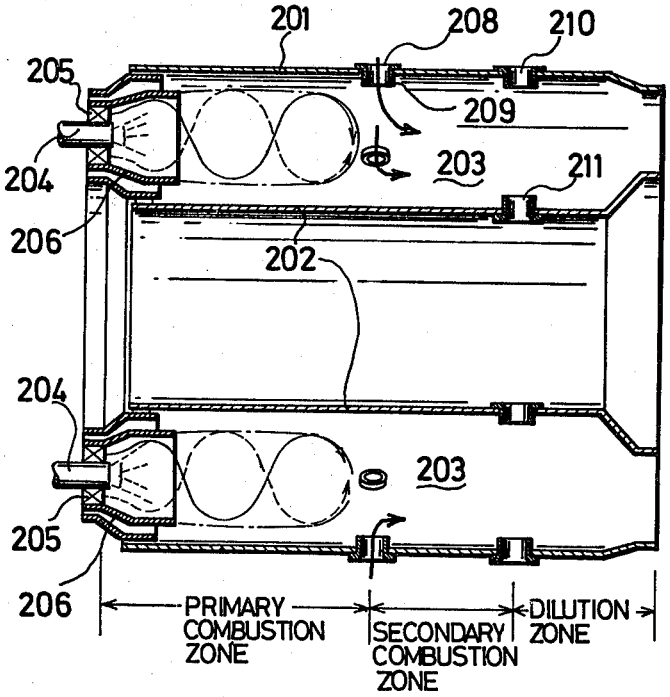
FIG. 11 is a longitudinal sectional view of a further embodiment of the invention.

Still another embodiment (of the annular type) will now be explained with reference to FIG. 11.

In the Figure the numeral 201 designates an outer cylinder and 202, an inner cylinder which is coaxially housed in the outer cylinder. The inner cylinder forms an annular space 203 in cross section, between itself and the outer cylinder.

A plurality of fuel injection valves 204 are installed in a circular arrangement at the upstream end of the annular space 203.

Primary combustion air swirlers 205, each of which is mounted around each fuel injection valve, have a swirl angle of 30°-35°.

Separators 206 of cylindrical, conical, or coni-cylindrical shape are provided around the combustion air swirlers 205, one for each, and extend downstream. Inside and outside of these separators, there are formed passages annular in cross section.

A plurality of secondary combustion air holes 208, each of which is equipped with a scoop 209, are formed through the wall portion of the outer cylinder 201 at points a certain distance downstream from the fuel injection valves 204.

Also, there are formed a plurality of dilution air holes 210, equipped with scoops 211, through the wall portions of the outer cylinder 201 and the inner cylinder 202 at points further downstream from the secondary combustion air holes 208.

At least either capacity of the fuel injection valves 204 or that of the primary combustion air swirlers 205 varies between neighboring valves or swirlers. In other words, those which operate at low and adequately high ratios of the supplied air amount to the theoretical amount of air are alternately arranged. This embodiment offers the same functions and advantages as with the embodiment already described in connection with FIGS. 8 and 9.

As has been described, the present invention provides a fuel combustion apparatus of great industrial importance having applications in continuous combustion furnaces, boilers, gas turbines and the like.

What is claimed is:

1. Fuel combustion apparatus comprising a double concentric combustion cylinder having an outer cylinder and an inner cylinder concentric with, and shorter than the outer one, said inner cylinder being located in the upstream portion of the space within the outer cylinder and extending axially to form an annular space therebetween, a plurality of fuel injection valves installed in a circular arrangement at the head of said annular space, primary combustion air swirlers mounted around each of the fuel injection valves, a secondary combustion air swirler installed at the inner end of the inner cylinder, a first set of air holes annularly disposed in the wall of the outer cylinder in a common plane comprising the outler plane of th inner cylinder and a second set of air holes annularly disposed in the wall of the outer cylinder in a common plane at an axial distance not less than the diameter of the outer cylinder downstream from the said first air holes, both said inner and outer cylinders being imperforate between the head ends thereof and the first set of air holes, and between the first and second sets of air holes thereby defining a primary burning zone in the annular space between said head end and said first set of air holes and a secondary burning zone axially adjacent and downstream thereof between said first and second sets of air holes, said fuel injection valves and primary combustion air swirlers supplying an air-fuel rich mixture to said primary burning zone for combustion therein and said first set of air holes introducing sufficient secondary air to the uncombusted exhaust from said primary zone to provide an air-fuel lean mixture in said secondary burning zone for combustion therein.

2. The fuel combustion apparatus according to claim 1 wherein each of said air holes are provided with scoops for directing the air in a radial direction.

3. Fuel combustion apparatus comprising a double concentric combustion cylinder having an outer cylinder and an inner cylinder concentric with, and shorter than the outer one, said inner cylinder being located in the upstream portion of the sapce within the outer cylinder and extending exially for form an annular space therebetween, a plurality of fuel injection valves installed in a circular arrangement at the head of said annular space, primary combustion air swirlers mounted around each of the fuel injection valves, a secondary combustion air swirler installed at the inner end of the inner cylinder, a first set of air holes annularly disposed in the wall of the outer cylinder in a common plane comprising the outlet plane of the inner cylinder and a second set of air holes annularly disposed in the wall of the outer cylinder in a common plane at an axial distance not less than the diameter of the outer cylinder downstream from the said first air holes, both said inner and outer cylinders being imperforate between the head ends thereof and the first set of air holes, and between the first and second sets of air holes thereby defining a primary burning zone in the annular space between said head end and said first set of air holes and a secondary burning zone axially adjacent and downstream thereof between said first and second sets of air holes, said fuel injection valves and primary combustion air swirlers supplying an air-fuel rich mixture to said primary burning zone for combustion therein and said secondary air swirlers and said first set of air holes introducing sufficient secondary air to the uncombusted exhaust from said primary zone to provide an air-fuel lean mixture in said secondary burning zone, each of the fuel injection valves and its associate primary swirler comprising a fuel burner system, the angle of swirl of each of the primary being arranged in a direction opposite to that of the primary swirler in its adjacent burner system, the capacity of the valve and/or of the swirler in each burner system being different from that or those of the adjacent systems so that those which operate at high and low ratios of the supplied amount of air to the theoretical amount of air are alternately arranged.

4. The fuel combustion apparatus according to claim 3 wherein said primary combustion air swirlers are disposed in the same angle of swirl in a given direction.

5. The fuel combustion apparatus according to claim 1 wherein said plurality of fuel injection valves are installed in a circular arrangement at the head of the annular space between the outer and inner cylinders, air separators surround each of the primary combustion air swirlers, each of said separators providing a skirt open in the flow space axially downstream from the fuel injection valve to permit supply of air for primary combustion from the inside and outside of each separator, at least the capacity of each said fuel injection valve or of the associated swirler being different from those of the adjacent ones so that the valve-swirler systems which operate at high and low ratios of the supplied amount of air to the theoretical amount of air are alternately arranged.

6. The fuel combustion apparatus of claim 5, wherein the air separators are cylindrical, conical or coni-cylindrical.

7. The fuel combustion apparatus according to claim 3 including moisture feeder means located within said inner cylinder for adding water or steam to the combustion air within the inner cylinder.

* * * * *